US008062512B2

(12) United States Patent
Yeggy et al.

(10) Patent No.: US 8,062,512 B2
(45) Date of Patent: Nov. 22, 2011

(54) PROCESSES FOR BITUMEN SEPARATION

(75) Inventors: Robert C. Yeggy, Maineville, OH (US); Vito J. Altavilla, Cincinnati, OH (US)

(73) Assignee: Vary Petrochem, LLC, Brooklyn, OH (US)

( * ) Notice: Subject to any disclaimer, the term of this patent is extended or adjusted under 35 U.S.C. 154(b) by 0 days.

(21) Appl. No.: 12/650,621

(22) Filed: Dec. 31, 2009

(65) Prior Publication Data

US 2010/0193403 A1 Aug. 5, 2010

Related U.S. Application Data

(63) Continuation-in-part of application No. 12/556,878, filed on Sep. 10, 2009, now Pat. No. 7,758,746, which is a continuation-in-part of application No. 11/868,031, filed on Oct. 5, 2007, now Pat. No. 7,749,379.

(60) Provisional application No. 60/828,501, filed on Oct. 6, 2006.

(51) Int. Cl.
*C11D 3/20* (2006.01)

(52) U.S. Cl. ..... 208/390; 510/505; 510/506; 558/70; 558/186; 558/187

(58) Field of Classification Search ..... 558/70, 558/186–187; 208/390
See application file for complete search history.

(56) References Cited

U.S. PATENT DOCUMENTS

| | | | |
|---|---|---|---|
| 3,331,896 | A | 7/1967 | Eiseman et al. |
| 3,547,803 | A | 12/1970 | Jorda et al. |
| 3,644,194 | A | 2/1972 | Keely et al. |
| 3,660,268 | A | 5/1972 | Kelly |
| 3,933,651 | A | 1/1976 | Erskine |
| 3,935,076 | A | 1/1976 | Cymbalisty |
| 3,948,754 | A | 4/1976 | McCollum et al. |
| 3,951,749 | A | 4/1976 | Fairbanks, Jr. et al. |
| 3,951,778 | A | 4/1976 | Willard, Sr. |
| 3,967,777 | A | 7/1976 | Canevari |
| 3,969,220 | A | 7/1976 | Anderson et al. |
| 3,978,925 | A | 9/1976 | Redford |
| 3,984,920 | A | 10/1976 | Raymond et al. |
| 3,985,684 | A | 10/1976 | Arey, Jr. et al. |
| 3,986,557 | A | 10/1976 | Striegler et al. |
| 3,986,592 | A | 10/1976 | Baillie et al. |
| 3,992,285 | A | 11/1976 | Hutchings |
| 3,994,341 | A | 11/1976 | Anderson et al. |
| 3,997,426 | A | 12/1976 | Montagna et al. |
| 4,008,765 | A | 2/1977 | Anderson et al. |
| 4,019,575 | A | 4/1977 | Pisio et al. |
| 4,019,578 | A | 4/1977 | Terry et al. |
| 4,024,915 | A | 5/1977 | Allen |
| 4,028,222 | A | 6/1977 | Prull |
| 4,036,732 | A | 7/1977 | Irani et al. |
| 4,046,668 | A | 9/1977 | Farcasiu et al. |
| 4,046,669 | A | 9/1977 | Blaine et al. |
| 4,048,078 | A | 9/1977 | Allen |
| 4,052,293 | A | 10/1977 | Mercer et al. |
| 4,054,505 | A | 10/1977 | Hart, Jr. et al. |
| 4,054,506 | A | 10/1977 | Hart, Jr. et al. |
| 4,057,485 | A | 11/1977 | Blaine et al. |
| 4,067,796 | A | 1/1978 | Alford et al. |
| 4,068,716 | A | 1/1978 | Allen |
| 4,068,717 | A | 1/1978 | Needham |
| 4,071,433 | A | 1/1978 | Hanson |
| 4,098,674 | A | 7/1978 | Rammler et al. |
| 4,108,760 | A | 8/1978 | Williams et al. |
| 4,110,194 | A * | 8/1978 | Peterson et al. ..... 208/390 |
| 4,115,246 | A | 9/1978 | Sweany |
| 4,120,775 | A | 10/1978 | Murray et al. |
| 4,120,776 | A | 10/1978 | Miller et al. |
| 4,127,170 | A | 11/1978 | Redford |
| 4,127,172 | A | 11/1978 | Redford et al. |
| 4,127,475 | A | 11/1978 | Farcasiu et al. |
| 4,133,382 | A | 1/1979 | Cram et al. |
| 4,139,450 | A | 2/1979 | Hanson et al. |
| 4,140,182 | A | 2/1979 | Vriend |
| 4,151,073 | A | 4/1979 | Comolli |
| 4,161,442 | A | 7/1979 | Audeh et al. |
| 4,174,263 | A | 11/1979 | Veatch et al. |
| 4,189,376 | A | 2/1980 | Mitchell |
| 4,197,183 | A | 4/1980 | Audeh |
| 4,213,862 | A | 7/1980 | Davis et al. |
| 4,224,138 | A | 9/1980 | Kruyer |
| 4,229,281 | A | 10/1980 | Alquist et al. |
| 4,236,995 | A | 12/1980 | Kruyer |
| 4,240,377 | A | 12/1980 | Johnson |
| 4,240,897 | A | 12/1980 | Clarke |
| 4,242,195 | A | 12/1980 | Rudnick |

(Continued)

FOREIGN PATENT DOCUMENTS

| | | |
|---|---|---|
| CA | 326747 | 10/1932 |
| CA | 448231 | 5/1948 |
| CA | 488928 | 12/1952 |
| CA | 493081 | 5/1953 |
| CA | 675930 | 12/1963 |
| CA | 778347 | 2/1968 |
| CA | 719690 | 8/1968 |
| CA | 914092 | 11/1972 |
| CA | 914094 | 11/1972 |
| CA | 915602 | 11/1972 |

(Continued)

OTHER PUBLICATIONS

Web page from www.nanochemtechnologies.net, "Products—Petro-Chemical," one page, dated Jul. 7, 2006.

Web pages from www.nanochemtechnologies.net, "ChemExtract(tm) History of Development," two pages, dated Jul. 7, 2006.

(Continued)

*Primary Examiner* — Walter D Griffin
*Assistant Examiner* — Brian McCaig
(74) *Attorney, Agent, or Firm* — Benesch Friedlander Coplan & Aronoff LLP

(57) ABSTRACT

Processes are provided for separating bitumen from oil sands and from other bitumen-containing compositions.

49 Claims, No Drawings

U.S. PATENT DOCUMENTS

| | | | | |
|---|---|---|---|---|
| 4,249,604 | A | | 2/1981 | Frazier |
| 4,250,016 | A | | 2/1981 | Estes et al. |
| 4,250,017 | A | | 2/1981 | Reale |
| 4,273,191 | A | | 6/1981 | Hradel |
| 4,280,559 | A | | 7/1981 | Best |
| 4,284,360 | A | | 8/1981 | Cymbalisty et al. |
| 4,293,035 | A | | 10/1981 | Fitch |
| 4,302,051 | A | | 11/1981 | Bass et al. |
| 4,302,326 | A | | 11/1981 | Bialek |
| 4,312,761 | A | | 1/1982 | Gitchel et al. |
| 4,333,529 | A | | 6/1982 | McCorquodale |
| 4,337,143 | A | | 6/1982 | Hanson et al. |
| 4,338,185 | A | | 7/1982 | Noelle |
| 4,341,619 | A | | 7/1982 | Poska |
| 4,342,639 | A | | 8/1982 | Gagon |
| 4,342,657 | A | | 8/1982 | Blair, Jr. |
| 4,343,691 | A | | 8/1982 | Minkkinen |
| 4,344,839 | A | | 8/1982 | Pachkowski et al. |
| 4,347,118 | A | | 8/1982 | Funk et al. |
| 4,347,126 | A | | 8/1982 | McGarry et al. |
| 4,357,230 | A | | 11/1982 | Sibley et al. |
| 4,358,373 | A | | 11/1982 | Jubenville |
| 4,361,476 | A | | 11/1982 | Brewer |
| 4,368,111 | A | | 1/1983 | Siefkin et al. |
| 4,383,914 | A | * | 5/1983 | Kizior ..... 208/177 |
| 4,385,982 | A | | 5/1983 | Anderson |
| 4,387,016 | A | | 6/1983 | Gagon |
| 4,396,491 | A | | 8/1983 | Stiller et al. |
| 4,399,038 | A | | 8/1983 | Yong |
| 4,399,039 | A | | 8/1983 | Yong |
| 4,401,552 | A | | 8/1983 | Elanchenny et al. |
| 4,409,090 | A | | 10/1983 | Hanson et al. |
| 4,409,091 | A | | 10/1983 | Kessick |
| 4,410,417 | A | | 10/1983 | Miller et al. |
| 4,414,194 | A | | 11/1983 | Blytas |
| 4,421,683 | A | | 12/1983 | Kukes et al. |
| 4,424,113 | A | | 1/1984 | Mitchell |
| 4,425,227 | A | | 1/1984 | Smith |
| 4,427,066 | A | | 1/1984 | Cook |
| 4,427,528 | A | | 1/1984 | Lindorfer et al. |
| 4,428,824 | A | | 1/1984 | Choi et al. |
| 4,429,744 | A | | 2/1984 | Cook |
| 4,429,745 | A | | 2/1984 | Cook |
| 4,437,998 | A | | 3/1984 | Yong |
| 4,446,012 | A | | 5/1984 | Murthy et al. |
| 4,450,911 | A | | 5/1984 | Shu et al. |
| 4,456,065 | A | | 6/1984 | Heim et al. |
| 4,456,533 | A | | 6/1984 | Seitzer |
| 4,457,827 | A | | 7/1984 | Chung et al. |
| 4,466,485 | A | | 8/1984 | Shu |
| 4,470,899 | A | | 9/1984 | Miller et al. |
| 4,473,461 | A | | 9/1984 | Thacker et al. |
| 4,474,616 | A | | 10/1984 | Smith et al. |
| 4,484,630 | A | | 11/1984 | Chung |
| 4,486,294 | A | | 12/1984 | Miller et al. |
| 4,489,782 | A | | 12/1984 | Perkins |
| 4,489,783 | A | | 12/1984 | Shu |
| 4,498,958 | A | | 2/1985 | Bialek |
| 4,503,910 | A | | 3/1985 | Shu |
| 4,508,172 | A | | 4/1985 | Mims et al. |
| 4,510,257 | A | | 4/1985 | Lewis et al. |
| 4,510,997 | A | | 4/1985 | Fitch et al. |
| 4,511,000 | A | | 4/1985 | Mims |
| 4,511,479 | A | | 4/1985 | Fuller et al. |
| 4,512,872 | A | | 4/1985 | Chung et al. |
| 4,514,283 | A | | 4/1985 | Closmann et al. |
| RE31,900 | E | | 5/1985 | Halverson |
| 4,519,894 | A | | 5/1985 | Walker |
| 4,521,292 | A | | 6/1985 | Spars et al. |
| 4,521,293 | A | | 6/1985 | Scinta et al. |
| 4,529,496 | A | | 7/1985 | Kruyer |
| 4,532,024 | A | | 7/1985 | Haschke et al. |
| 4,533,459 | A | | 8/1985 | Dente et al. |
| 4,536,279 | A | | 8/1985 | Audeh |
| 4,539,093 | A | | 9/1985 | Friedman et al. |
| 4,539,096 | A | | 9/1985 | Rudnick |
| 4,539,097 | A | | 9/1985 | Kelterborn et al. |
| 4,557,821 | A | | 12/1985 | Lopez et al. |
| 4,561,965 | A | | 12/1985 | Minkkinen |
| 4,565,249 | A | | 1/1986 | Pebdani et al. |
| 4,578,181 | A | | 3/1986 | Derouane et al. |
| 4,582,593 | A | | 4/1986 | Bialek |
| 4,587,006 | A | | 5/1986 | Minden |
| 4,588,476 | A | | 5/1986 | Warzel |
| 4,595,239 | A | | 6/1986 | Ayler et al. |
| 4,596,651 | A | | 6/1986 | Wolff et al. |
| 4,597,443 | A | | 7/1986 | Shu et al. |
| 4,597,852 | A | | 7/1986 | York et al. |
| 4,603,115 | A | | 7/1986 | Schweighardt |
| 4,606,812 | A | | 8/1986 | Swanson |
| 4,607,699 | A | | 8/1986 | Stephens |
| 4,615,796 | A | | 10/1986 | Kramer |
| 4,620,592 | A | | 11/1986 | Perkins |
| 4,620,593 | A | | 11/1986 | Haagensen |
| 4,635,720 | A | | 1/1987 | Chew |
| 4,637,992 | A | | 1/1987 | Lewis et al. |
| 4,651,826 | A | | 3/1987 | Holmes |
| 4,652,342 | A | * | 3/1987 | Kuerston ..... 201/33 |
| 4,660,645 | A | | 4/1987 | Newlove et al. |
| 4,671,801 | A | | 6/1987 | Burgess et al. |
| 4,675,120 | A | | 6/1987 | Martucci |
| 4,676,312 | A | | 6/1987 | Gussow |
| 4,676,908 | A | | 6/1987 | Ciepiela et al. |
| 4,679,626 | A | | 7/1987 | Perkins |
| 4,683,029 | A | | 7/1987 | Oyler et al. |
| 4,692,238 | A | | 9/1987 | Bodle et al. |
| 4,695,373 | A | | 9/1987 | Ho |
| 4,699,709 | A | | 10/1987 | Peck |
| 4,704,200 | A | | 11/1987 | Keane |
| 4,719,008 | A | | 1/1988 | Sparks et al. |
| 4,721,560 | A | | 1/1988 | York et al. |
| 4,724,068 | A | | 2/1988 | Stapp |
| 4,730,671 | A | | 3/1988 | Perkins |
| 4,738,795 | A | | 4/1988 | Farnand |
| 4,741,835 | A | | 5/1988 | Jacques et al. |
| 4,747,920 | A | | 5/1988 | Muralidhara et al. |
| 4,761,391 | A | | 8/1988 | Occelli |
| 4,765,885 | A | | 8/1988 | Sadeghi et al. |
| 4,783,268 | A | | 11/1988 | Leung |
| 4,786,368 | A | | 11/1988 | York et al. |
| 4,812,225 | A | | 3/1989 | corti et al. |
| 4,817,185 | A | | 3/1989 | Yamaguchi et al. |
| 4,818,370 | A | | 4/1989 | Gregoli et al. |
| 4,818,373 | A | | 4/1989 | Bartholic et al. |
| 4,822,481 | A | | 4/1989 | Taylor |
| 4,856,587 | A | | 8/1989 | Nielson |
| 4,857,496 | A | | 8/1989 | Lopez et al. |
| 4,875,998 | A | | 10/1989 | Rendall |
| 4,880,528 | A | | 11/1989 | Westhoff et al. |
| 4,882,041 | A | | 11/1989 | Scott et al. |
| 4,888,108 | A | | 12/1989 | Farnand |
| 4,906,355 | A | | 3/1990 | Lechnick et al. |
| 4,912,971 | A | | 4/1990 | Jeambey |
| 4,929,341 | A | | 5/1990 | Thirumalachar et al. |
| 4,952,306 | A | | 8/1990 | Sawyer et al. |
| 4,952,544 | A | | 8/1990 | McCauley |
| 4,961,467 | A | | 10/1990 | Pebdani |
| 4,966,685 | A | | 10/1990 | Hall et al. |
| 4,968,412 | A | | 11/1990 | Guymon |
| 4,970,190 | A | | 11/1990 | Lopez et al. |
| 4,981,579 | A | | 1/1991 | Paspek et al. |
| 4,988,427 | A | | 1/1991 | Wright |
| 4,993,490 | A | | 2/1991 | Stephens et al. |
| 4,994,172 | A | | 2/1991 | Buchanan et al. |
| 4,994,175 | A | | 2/1991 | Hargreaves et al. |
| 5,000,872 | A | | 3/1991 | Olah |
| 5,017,281 | A | | 5/1991 | Sadeghi et al. |
| 5,036,917 | A | | 8/1991 | Jennings, Jr. et al. |
| 5,039,227 | A | | 8/1991 | Leung et al. |
| 5,055,212 | A | | 10/1991 | Le |
| 5,066,388 | A | | 11/1991 | Ross |
| 5,071,807 | A | | 12/1991 | Kennedy et al. |
| 5,073,251 | A | | 12/1991 | Daniels |
| 5,083,613 | A | | 1/1992 | Gregoli et al. |
| 5,084,079 | A | | 1/1992 | Frohnert et al. |
| 5,087,379 | A | | 2/1992 | Morton et al. |
| 5,089,052 | A | | 2/1992 | Ludwig |

| | | | | |
|---|---|---|---|---|
| 5,096,461 | A | 3/1992 | Frankiewicz et al. | |
| 5,096,567 | A | 3/1992 | Paspek, Jr. et al. | |
| 5,097,903 | A | 3/1992 | Wilensky | |
| 5,098,481 | A | 3/1992 | Monlux | |
| 5,110,443 | A | 5/1992 | Gregoli et al. | |
| 5,122,259 | A | 6/1992 | Nielson | |
| 5,124,008 | A | 6/1992 | Rendall et al. | |
| 5,143,598 | A | 9/1992 | Graham et al. | |
| 5,145,002 | A | 9/1992 | McKay | |
| 5,154,831 | A | 10/1992 | Darian et al. | |
| 5,156,686 | A | 10/1992 | Van Slyke | |
| 5,169,518 | A | 12/1992 | Klimpel et al. | |
| 5,173,172 | A | 12/1992 | Adams et al. | |
| 5,178,733 | A | 1/1993 | Nielson | |
| 5,198,596 | A | 3/1993 | Kaminsky et al. | |
| 5,213,625 | A | 5/1993 | Van Slyke | |
| 5,215,596 | A | 6/1993 | Van Slyke | |
| 5,223,148 | A | 6/1993 | Tipman et al. | |
| 5,234,577 | A | 8/1993 | Van Slyke | |
| 5,236,577 | A | 8/1993 | Tipman et al. | |
| 5,242,580 | A | 9/1993 | Sury | |
| 5,252,138 | A | 10/1993 | Guymon | |
| 5,264,118 | A | 11/1993 | Cymerman et al. | |
| 5,275,507 | A | 1/1994 | Hutter | |
| 5,282,984 | A | 2/1994 | Ashrawi | |
| 5,283,001 | A | 2/1994 | Gregoli et al. | |
| 5,286,386 | A | 2/1994 | Darian et al. | |
| 5,290,959 | A | 3/1994 | Rice | |
| 5,297,626 | A | 3/1994 | Vinegar et al. | |
| 5,316,659 | A | 5/1994 | Brons et al. | |
| 5,316,664 | A | 5/1994 | Gregoli et al. | |
| 5,320,746 | A | 6/1994 | Green et al. | |
| 5,326,456 | A | 7/1994 | Brons et al. | |
| 5,340,467 | A | 8/1994 | Gregoli et al. | |
| 5,358,917 | A | 10/1994 | Van Veen et al. | |
| 5,364,524 | A | 11/1994 | Partridge et al. | |
| 5,370,789 | A | 12/1994 | Milne et al. | |
| 5,374,350 | A | 12/1994 | Heck et al. | |
| 5,392,854 | A | 2/1995 | Vinegar et al. | |
| 5,453,133 | A | 9/1995 | Sparks et al. | |
| 5,480,566 | A | 1/1996 | Strand | |
| 5,534,136 | A | 7/1996 | Rosenbloom | |
| 5,564,574 | A | 10/1996 | Kuryluk | |
| 5,569,434 | A | 10/1996 | Devanathan et al. | |
| 5,626,743 | A | 5/1997 | Humphreys | |
| 5,645,714 | A | 7/1997 | Strand et al. | |
| 5,690,811 | A | 11/1997 | Davis et al. | |
| 5,695,632 | A | 12/1997 | Brons et al. | |
| 5,723,042 | A | 3/1998 | Strand et al. | |
| 5,744,065 | A | 4/1998 | Galante et al. | |
| 5,746,909 | A | 5/1998 | Calta | |
| 5,762,780 | A | 6/1998 | Rendall et al. | |
| 5,770,049 | A | 6/1998 | Humphreys | |
| 5,795,444 | A | 8/1998 | Rendall et al. | |
| 5,795,464 | A | 8/1998 | Sankey et al. | |
| 5,846,314 | A | 12/1998 | Golley | |
| 5,855,243 | A | 1/1999 | Bragg | |
| 5,902,554 | A | 5/1999 | Kirkbride | |
| 5,911,541 | A | 6/1999 | Johnson | |
| 5,919,353 | A | 7/1999 | Itou et al. | |
| 5,923,170 | A | 7/1999 | Kuckes | |
| 5,927,404 | A | 7/1999 | Bragg | |
| 5,957,202 | A | 9/1999 | Huang | |
| 5,968,349 | A | 10/1999 | Duyvesteyn et al. | |
| 5,968,370 | A * | 10/1999 | Trim | 210/723 |
| 5,985,138 | A | 11/1999 | Humphreys | |
| 5,998,640 | A | 12/1999 | Haefele et al. | |
| 6,004,455 | A | 12/1999 | Rendall | |
| 6,007,708 | A | 12/1999 | Allcock et al. | |
| 6,007,709 | A | 12/1999 | Duyvesteyn et al. | |
| 6,019,499 | A | 2/2000 | Selivanov | |
| 6,019,888 | A | 2/2000 | Mishra et al. | |
| 6,030,467 | A | 2/2000 | Leser et al. | |
| 6,036,844 | A | 3/2000 | Gupta et al. | |
| 6,068,054 | A | 5/2000 | Bragg | |
| 6,110,359 | A | 8/2000 | Davis et al. | |
| 6,119,870 | A | 9/2000 | Maciejewski et al. | |
| 6,139,722 | A | 10/2000 | Kirkbride et al. | |
| 6,152,356 | A | 11/2000 | Minden | |
| 6,153,017 | A | 11/2000 | Ward et al. | |
| 6,207,044 | B1 | 3/2001 | Brimhall | |
| 6,214,213 | B1 | 4/2001 | Tipman et al. | |
| 6,258,772 | B1 | 7/2001 | Yeggy et al. | |
| 6,267,716 | B1 | 7/2001 | Quintero | |
| 6,279,653 | B1 | 8/2001 | Wegener et al. | |
| 6,306,917 | B1 | 10/2001 | Bohn et al. | |
| 6,319,395 | B1 | 11/2001 | Kirkbride et al. | |
| 6,358,404 | B1 | 3/2002 | Brown et al. | |
| 6,375,976 | B1 | 4/2002 | Roden et al. | |
| 6,402,934 | B1 | 6/2002 | Chheda et al. | |
| 6,451,885 | B1 | 9/2002 | Drdesin et al. | |
| 6,464,856 | B1 | 10/2002 | Di Tullio | |
| 6,494,932 | B1 | 12/2002 | Abercrombie | |
| 6,527,960 | B1 | 3/2003 | Bacon et al. | |
| 6,576,145 | B2 | 6/2003 | Conaway et al. | |
| 6,662,872 | B2 | 12/2003 | Gutek et al. | |
| 6,673,238 | B2 | 1/2004 | Gerhold et al. | |
| 6,709,573 | B2 | 3/2004 | Smith | |
| 6,733,636 | B1 | 5/2004 | Heins | |
| 6,743,290 | B2 | 6/2004 | Dahl et al. | |
| 6,746,599 | B2 | 6/2004 | Cymerman et al. | |
| 6,749,678 | B1 | 6/2004 | Reynhout | |
| 6,758,963 | B1 | 7/2004 | Hantzer et al. | |
| 6,821,060 | B2 | 11/2004 | McTurk et al. | |
| 6,883,607 | B2 | 4/2005 | Nenniger et al. | |
| 6,904,919 | B2 | 6/2005 | Taylor-Smith et al. | |
| 6,936,178 | B2 | 8/2005 | Peloquin et al. | |
| 6,936,543 | B2 | 8/2005 | Schroeder et al. | |
| 7,008,528 | B2 | 3/2006 | Mitchell et al. | |
| 7,097,255 | B2 | 8/2006 | Drake et al. | |
| RE39,289 | E | 9/2006 | Mitchell et al. | |
| 7,141,162 | B2 | 11/2006 | Garner et al. | |
| 7,150,320 | B2 | 12/2006 | Heins | |
| 7,168,641 | B2 | 1/2007 | Filgueiras | |
| 7,186,673 | B2 | 3/2007 | Varadaraj et al. | |
| 7,189,196 | B2 | 3/2007 | Cornay et al. | |
| 7,192,092 | B2 | 3/2007 | Watson | |
| 7,201,804 | B2 | 4/2007 | Tunnicliffe et al. | |
| 7,256,242 | B2 | 8/2007 | Nelson | |
| 7,258,788 | B2 | 8/2007 | Pollock | |
| 7,270,743 | B2 | 9/2007 | Freel et al. | |
| 7,294,156 | B2 | 11/2007 | Chakrabarty et al. | |
| 7,338,924 | B2 | 3/2008 | Varadaraj | |
| 7,341,658 | B2 | 3/2008 | Reeves | |
| 7,363,973 | B2 | 4/2008 | Nenniger et al. | |
| 7,399,406 | B2 | 7/2008 | Mikula et al. | |
| 7,416,671 | B2 | 8/2008 | Bozak et al. | |
| 7,428,926 | B2 | 9/2008 | Heins | |
| 7,438,129 | B2 | 10/2008 | Heins | |
| 7,438,807 | B2 | 10/2008 | Garner et al. | |
| 7,448,692 | B2 | 11/2008 | Drake et al. | |
| 7,459,413 | B2 | 12/2008 | Shen et al. | |
| 7,553,423 | B2 | 6/2009 | Buddenberg et al. | |
| 7,597,144 | B2 | 10/2009 | Minnich et al. | |
| 2003/0083206 | A1 | 5/2003 | Masikewich et al. | |
| 2005/0161372 | A1 | 7/2005 | Colic | |
| 2005/0197267 | A1 | 9/2005 | Zaki et al. | |
| 2007/0205141 | A1 * | 9/2007 | Freeman et al. | 208/390 |
| 2008/0210602 | A1 * | 9/2008 | Duyvesteyn | 208/390 |

FOREIGN PATENT DOCUMENTS

| | | |
|---|---|---|
| CA | 915603 | 11/1972 |
| CA | 915604 | 11/1972 |
| CA | 915608 | 11/1972 |
| CA | 917565 | 12/1972 |
| CA | 917585 | 12/1972 |
| CA | 949482 | 6/1974 |
| CA | 975696 | 10/1975 |
| CA | 975697 | 10/1975 |
| CA | 975698 | 10/1975 |
| CA | 975699 | 10/1975 |
| WO | 9510369 | 4/1995 |

OTHER PUBLICATIONS

Web pages from www.nanochemtechnologies.net, "ChemExtract(tm) Material Safety Data Sheet," two pages, dated Jul. 7, 2006.

Supplementary Partial European Search Report for Application No. EP 07 87 1125, dated Dec. 2, 2009, eight pages.
Online Technical Bulletin XP-002555082 of BASF Corporation, entitled MAPHOS 66 H Aromatic Phosphate Ester, dated 2002, one page.
European Patent Office Communication pursuant to Article 94(3) EPC, regarding Application No. 07871125.6-2104, dated Mar. 18, 2010.
International Preliminary Report on Patentability from related PCT Application No. PCT/US2007/080563, Jul. 25, 2008.
International Search Report from related PCT Application No. PCT/US2007/080563, Jul. 25, 2008.
Written Opinion from related PCT Application No. PCT/US2007/080563, Jul. 25, 2008.
Office Action from related U.S. Appl. No. 12/765,969, Jun. 7, 2010.
Office Action from related U.S. Appl. No. 12/765,982, Jun. 7, 2010.
Notice of Allowance from related U.S. Appl. No. 11/868,031, Feb. 22, 2010.
Notice of Allowance from related U.S. Appl. No. 12/556,878, Mar. 3, 2010.
Notice of Allowance and Fee(s) Due dated Jun. 22, 2010 for U.S. Appl. No. 12/761,845.
Notice of Allowance and Fee(s) Due dated Aug. 24, 2010 for U.S. Appl. No. 12/765,982.
Notice of Allowance and Fee(s) Due dated Aug. 25, 2010 for U.S. Appl. No. 12/765,969.
U.S. Office Action—corresponding U.S. Appl. No. 12/952,963, filed Nov. 23, 2010; Dated May 9, 2011 (6 pages).
U.S. Office Action—corresponding U.S. Appl. No. 12/952,037, filed Nov. 23, 2010; Dated May 11, 2011 (5 pages).

* cited by examiner

PROCESSES FOR BITUMEN SEPARATION

RELATED U.S. APPLICATION DATA

This application is a continuation in part application of U.S. Non-Provisional application Ser. No. 12/556,878, filed on Sep. 10, 2009, now U.S. Pat. No. 7,758,746, which is a continuation in part of U.S. Non Provisional application Ser. No. 11/868,031, filed Oct. 5, 2007, now U.S. Pat. No. 7,749,379, which claims the benefit of priority from U.S. Provisional Application No. 60/828,501, filed on Oct. 6, 2006. The entire disclosures of the earlier applications are hereby incorporated by reference.

BACKGROUND

Oil sands, also known as "tar sands" and "bituminous sands," are a mixture of bitumen (tar), sand, and water. Bitumen is a heavy, viscous crude oil, having relatively high sulfur content. When properly separated from the oil sands, bitumen may be processed to synthetic crude oil suitable for use as a feedstock for the production of liquid motor fuels, heating oil, and petrochemicals. Oil sand fields exist throughout most of the world. Particularly significant deposits exist in Canada, including the Athabasca oil sands in Alberta, the United States, including the Utah oil sands, South America, including the Orinoco oil sands in Venezuela, and Africa, including the Nigerian oil sands. A majority of all of the known oil in the world is contained in oil sands.

Bitumen is very difficult to separate from oil sands in an efficient and environmentally acceptable manner. Current efforts to separate bitumen from oil sands typically yield only about 85-92% of the available bitumen. Moreover, current efforts to separate bitumen from oil sands include the creation of emulsions, or "froth," during processing, requiring the use of environmentally harmful organic solvents such as naphtha to "crack" the emulsions and allow for further processing. In addition, the bitumen that remains in the sand (and other particulate matter, such as clay) component of the oil sands contributes to the creation of a heavy sludge, often referred to as "tailings." Current practice for the disposal of the tailings, which are comprised of unrecovered bitumen, sand (and other particulate matter), and water is to pump the tailings into huge tailings ponds, where the sand and other particulate matter slowly settle and stratify over the course of several years.

SUMMARY

The present exemplary embodiments describe compositions and methods for separating bitumen from oil sands in an efficient and environmentally acceptable manner, and for separating residual bitumen from existing tailings or from other bitumen-containing compositions.

According to one aspect of the present embodiments, a composition is provided, comprising a separating composition comprising a hydrotropic agent and a dispersant having flocculating characteristics, wherein the separating composition has a pH of greater than 7.5. According to another aspect of the present embodiments, a composition is provided, comprising a separating composition comprising a wetting agent in the amount of from about 0.001% to about 2.5% by weight of the separating composition, a hydrotropic agent, and a dispersant having flocculating characteristics, wherein the separating composition has a pH of greater than 7.5.

According to another aspect of the present embodiments, a separating composition is provided, comprising from about 0.1% to about 4.0% by weight of a hydrotropic agent; and from about 0.25% to about 4.5% by weight of a dispersant having flocculating characteristics. According to another aspect of the present embodiments, a separating composition is provided, comprising from about 0.001% to about 2.5% by weight of a wetting agent; from about 0.1% to about 4.0% by weight of a hydrotropic agent; and from about 0.25% to about 4.5% by weight of a dispersant having flocculating characteristics.

According to another aspect of the present embodiments, a separating composition for separating bitumen from oil sands or tailings is provided, comprising from about 0.1% to about 4.0% by weight of an aromatic phosphate ester having the formula:

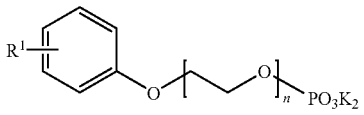

wherein $R^1$ is a $C_1$-$C_5$ linear or branched alkyl group and n=1 to 8; from about 0.001% to about 4.5% by weight of sodium pyrophosphate; from about 0.001% to about 4.5% by weight of tetrapotassium pyrophosphate; from about 2% to about 9.5% by weight of sodium hydroxide; and from about 1.7% to about 8.6% by weight of phosphoric acid, wherein the separating composition has a pH of from about 7.0 to about 8.5. According to another aspect of the present embodiments, a separating composition for separating bitumen from oil sands or tailings is provided, comprising from about 0.001% to about 2.5% by weight of 2,5,8,11-tetramethyl-6-dodecyn-5,8-diol ethoxylate; from about 0.1% to about 4.0% by weight of an aromatic phosphate ester having the formula:

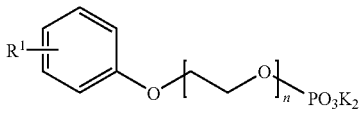

wherein $R^1$ is a $C_1$-$C_5$ linear or branched alkyl group and n=1 to 8; from about 0.001% to about 4.5% by weight of sodium pyrophosphate; from about 0.001% to about 4.5% by weight of tetrapotassium pyrophosphate; from about 2% to about 9.5% by weight of sodium hydroxide; and from about 1.7% to about 8.6% by weight of phosphoric acid, wherein the separating composition has a pH of from about 7.0 to about 8.5.

DETAILED DESCRIPTION

As used herein, the term "about" means "approximately," and, in any event, may indicate as much as a 10% deviation from the number being modified.

As used herein, "essentially free" means an amount less than about 0.1%.

In one embodiment, a composition is provided, comprising a separating composition comprising a hydrotropic agent, and a dispersant having flocculating characteristics, wherein the separating composition has a pH of greater than 7.5.

In one embodiment, the composition further comprises a wetting agent. The wetting agent may be present in various amounts ranging from about 0.001% to about 2.5% by weight of the separating composition. In other embodiments, the wetting agent may be present in amounts ranging from about 0.001% to about 1%, about 0.01% to about 2.5%, about 0.01% to about 1%, or about 0.1% to about 0.5%. Suitable wetting agents may include, for example, one or more of DYNOL™ 607 Surfactant (Air Products and Chemicals, Inc.), SURFYNOL® 420 (Air Products and Chemicals, Inc.), SURFYNOL® 440 (Air Products and Chemicals, Inc.), SURFYNOL® 465 (Air Products and Chemicals, Inc.), SURFYNOL® 485 (Air Products and Chemicals, Inc.), DYNOL™ 604 Surfactant (Air Products and Chemicals, Inc.), TOMADOL® 91-2.5 (Tomah Products, Inc.), TOMADOL® 91-6 (Tomah Products, Inc.), TOMADOL® 91-8 (Tomah Products, Inc.), TOMADOL® 1-3 (Tomah Products, Inc.), TOMADOL® 1-5 (Tomah Products, Inc.), TOMADOL® 1-7 (Tomah Products, Inc.), TOMADOL® 1-73B (Tomah Products, Inc.), TOMADOL® 1-9 (Tomah Products, Inc.), TOMADOL® 23-1 (Tomah Products, Inc.), TOMADOL® 23-3 (Tomah Products, Inc.), TOMADOL® 23-5 (Tomah Products, Inc.), TOMADOL® 23-6.5 (Tomah Products, Inc.), TOMADOL® 25-3 (Tomah Products, Inc.), TOMADOL® 25-7 (Tomah Products, Inc.), TOMADOL® 25-9 (Tomah Products, Inc.), TOMADOL® 25-12 (Tomah Products, Inc.), TOMADOL® 45-7 (Tomah Products, Inc.), TOMADOL® 45-13 (Tomah Products, Inc.), TRITON™ X-207 Surfactant (Dow Chemical Company), TRITON™ CA Surfactant (Dow Chemical Company), NOVEC™ Fluorosurfactant FC-4434 (3M Company), POLYFOX™ AT-1118B (Omnova Solutions, Inc.), ZONYL® 210 (Dupont), ZONYL® 225 (Dupont), ZONYL® 321 (Dupont), ZONYL® 8740 (Dupont), ZONYL® 8834L (Dupont), ZONYL® 8857A (Dupont), ZONYL® 8952 (Dupont), ZONYL® 9027 (Dupont), ZONYL® 9338 (Dupont), ZONYL® 9360 (Dupont), ZONYL® 9361 (Dupont), ZONYL® 9582 (Dupont), ZONYL® 9671 (Dupont), ZONYL® FS-300 (Dupont), ZONYL® FS-500 (Dupont), ZONYL® FS-610 (Dupont), ZONYL® 1033D (Dupont), ZONYL® FSE (DuPont), ZONYL® FSK (DuPont), ZONYL® FSH (DuPont), ZONYL® FSJ (DuPont), ZONYL® FSA (DuPont), ZONYL® FSN-100 (DuPont), LUTENSOL® OP 30-70% (BASF), LUTENSOL® A 12 N (BASF), LUTENSOL® A 3 N (BASF), LUTENSOL® A 65 N (BASF), LUTENSOL® A 9 N (BASF), LUTENSOL® AO 3 (BASF), LUTENSOL® AO 4 (BASF), LUTENSOL® AO 8 (BASF), LUTENSOL® AT 25 (BASF), LUTENSOL® AT 55 PRILL SURFACTANT (BASF), LUTENSOL® CF 10 90 SURFACTANT (BASF), LUTENSOL® DNP 10 (BASF), LUTENSOL® NP 4 (BASF), LUTENSOL® NP 10 (BASF), LUTENSOL® NP-100 PASTILLE (BASF), LUTENSOL® NP-6 (BASF), LUTENSOL® NP-70-70% (BASF), LUTENSOL® NP-50 (BASF), LUTENSOL® NP 9 (BASF), LUTENSOL® ON 40 SURFACTANT (BASF), LUTENSOL® ON 60 (BASF), LUTENSOL® OP-10 (BASF), LUTENSOL® TDA 10 SURFACTANT (BASF), LUTENSOL® TDA 3 SURFACTANT (BASF), LUTENSOL® TDA 6 SURFACTANT (BASF), LUTENSOL® TDA 9 SURFACTANT (BASF), LUTENSOL® XL 69 (BASF), LUTENSOL® XL 100 (BASF), LUTENSOL® XL 140 (BASF), LUTENSOL® XL 40 (BASF), LUTENSOL® XL 50 (BASF), LUTENSOL® XL 60 (BASF), LUTENSOL® XL 70 (BASF), LUTENSOL® XL 79 (BASF), LUTENSOL® XL 80 (BASF), LUTENSOL® XL 89 (BASF), LUTENSOL® XL 90 (BASF), LUTENSOL® XL 99 (BASF), LUTENSOL® XP 100 (BASF), LUTENSOL® XP 140 (BASF), LUTENSOL® XP 30 (BASF), LUTENSOL® XP 40 (BASF), LUTENSOL® XP 50 (BASF), LUTENSOL® XP 60 (BASF), LUTENSOL® XP 69 (BASF), LUTENSOL® XP 70 (BASF), LUTENSOL® XP 79 (BASF), LUTENSOL® XP 80 (BASF), LUTENSOL® XP 89 (BASF), LUTENSOL® XP 90 (BASF), LUTENSOL® XP 99 (BASF), MACOL® 16 SURFACTANT (BASF), MACOL® CSA 20 POLYETHER (BASF), MACOL® LA 12 SURFACTANT (BASF), MACOL® LA 4 SURFACTANT (BASF), MACOL® LF 110 SURFACTANT (BASF), MACOL® LF 125A SURFACTANT (BASF), MAZON® 1651 SURFACTANT (BASF), MAZOX® LDA Lauramine OXIDE (BASF), PLURAFAC® AO8A Surfactant (BASF), PLURAFAC® B-26 Surfactant (BASF), PLURAFAC® B25-5 Surfactant (BASF), PLURAFAC® D25 Surfactant (BASF), PLURAFAC® LF 1200 Surfactant (BASF), PLURAFAC® LF 2210 Surfactant (BASF), PLURAFAC® LF 4030 Surfactant (BASF), PLURAFAC® LF 7000 Surfactant (BASF), PLURAFAC® RA-20 Surfactant (BASF), PLURAFAC® RA 30 Surfactant (BASF), PLURAFAC® RA 40 Surfactant (BASF), PLURAFAC® RCS 43 Surfactant (BASF), PLURAFAC® RCS 48 Surfactant (BASF), PLURAFAC® S205LF Surfactant (BASF), PLURAFAC® S305LF Surfactant (BASF), PLURAFAC® S505LF Surfactant (BASF), PLURAFAC® SL 62 Surfactant (BASF), PLURAFAC® SL 92 Surfactant (BASF), PLURAFAC® SL-22 Surfactant (BASF), PLURAFAC® SL-42 Surfactant (BASF), PLURAFAC® SLF 37 Surfactant (BASF), PLURAFAC® SLF-18 Surfactant (BASF), PLURAFAC® SLF-18B-45 Surfactant (BASF), PLURAFAC® L1220 Surfactant (BASF), PLURONIC® 10R5SURFACTANT (BASF), PLURONIC® 17R2 (BASF), PLURONIC® 17R4 (BASF), PLURONIC® 25R2 (BASF), PLURONIC® 25R4 (BASF), PLURONIC® 31R1 (BASF), PLURONIC® F108 CAST SOLID SURFACTANT (BASF), PLURONIC® F108 NF CAST SOLID SURFACTANT (BASF), PLURONIC® F108 NF PRILL SURFACTANT (BASF), PLURONIC® F108 PASTILLE SURFACTANT (BASF), PLURONIC® F127 CAST SOLID SURFACTANT (BASF), PLURONIC® F127 NF PRILL Surfactant (BASF), PLURONIC® F127NF 500BHT CAST SOLID SURFACTANT (BASF), PLURONIC® F38 CAST SOLID SURFACTANT (BASF), PLURONIC® PASTILLE (BASF), PLURONIC® F68 LF PASTILLE SURFACTANT (BASF), PLURONIC® F68 CAST SOLID SURFACTANT (BASF), PLURONIC® F77 CAST SOLID SURFACTANT (BASF), PLURONIC® F-77 MICRO PASTILLE SURFACTANT (BASF), PLURONIC® F87 CAST SOLID SURFACTANT (BASF), PLURONIC® F88 CAST SOLID SURFACTANT (BASF), PLURONIC® F98 CAST SOLID SURFACTANT (BASF), PLURONIC® L10 SURFACTANT (BASF), PLURONIC® L101 SURFACTANT (BASF), PLURONIC® L121 SURFACTANT (BASF), PLURONIC® L31 SURFACTANT (BASF), PLURONIC® L92 SURFACTANT (BASF), PLURONIC® N-3 SURFACTANT (BASF), PLURONIC® P103 SURFACTANT (BASF), PLURONIC® P105 SURFACTANT (BASF), PLURONIC® P123 SURFACTANT (BASF), PLURONIC® P65 SURFACTANT (BASF), PLURONIC® P84 SURFACTANT (BASF), PLURONIC® P85 SURFACTANT (BASF), TETRONIC® 1107 micro-PASTILLE SURFACTANT (BASF), TETRONIC® 1107 SURFACTANT (BASF), TETRONIC® 1301 SURFACTANT (BASF), TETRONIC® 1304 SURFACTANT (BASF), TETRONIC® 1307 Surfactant (BASF), TETRONIC® 1307 SURFACTANT PASTILLE (BASF), TETRONIC® 150R1 SURFACTANT (BASF), TETRONIC® 304 SURFACTANT (BASF), TETRONIC® 701 SURFACTANT (BASF), TETRONIC® 901 SURFACTANT (BASF), TETRONIC® 904 SURFACTANT (BASF), TETRONIC® 908 CAST SOLID SURFACTANT (BASF), and TETRONIC® 908 PASTILLE SURFACTANT (BASF), and mixtures thereof. In one specific embodiment, the wetting agent may include one or more ethoxylated acetylenic alcohols, such as, for example, 2,5,8,11-tetramethyl-6-dodecyn-5,8-diol ethoxylate.

In another embodiment, the composition excludes a wetting agent. In one embodiment, the exclusion of a wetting agent allows for an increased surface tension in the composition. Lower surface tensions may encourage the formation of emulsions that interfere with the flocculation of solids out of the composition when applied to oil sands. Lower surface tension further may interfere with the transference of mechanical energy within the system.

Suitable hydrotropic agents may include, for example, one or more of TRITON® H-66 (Dow Chemical Company), TRITON® H-55 (Dow Chemical Company), TRITON® QS-44 (Dow Chemical Company), TRITON® XQS-20 (Dow Chemical Company), TRITON® X-15 (Union Carbide Corporation), TRITON® X-35 (Union Carbide Corporation), TRITON® X-45 (Union Carbide Corporation), TRITON® X-114 (Union Carbide Corporation), TRITON® X-100 (Union Carbide Corporation), TRITON® X-165 (70%) active (Union Carbide Corporation), TRITON® X-305 (70%) active (Union Carbide Corporation), TRITON® X-405 (70%) active (Union Carbide Corporation), TRITON® BG Nonionic Surfactant (Union Carbide Corporation), TERGITOL® MinFoam 1X (Dow Chemical Company), TERGITOL® L-61 (Dow Chemical Company), TERGITOL® L-64 (Dow Chemical Company), TERGITOL® L-81 (Dow Chemical Company), TERGITOL® L-101 (Dow Chemical Company), TERGITOL® NP-4 (Dow Chemical Company), TERGITOL® NP-6 (Dow Chemical Company), TERGITOL® NP-7 (Dow Chemical Company), TERGITOL® NP-8 (Dow Chemical Company), TERGITOL® NP-9 (Dow Chemical Company), TERGITOL® NP-11 (Dow Chemical Company), TERGITOL® NP-12 (Dow Chemical Company), TERGITOL® NP-13 (Dow Chemical Company), TERGITOL® NP-15 (Dow Chemical Company), TERGITOL® NP-30 (Dow Chemical Company), TERGITOL® NP-40 (Dow Chemical Company), SURFYNOL® 420 (Air Products and Chemicals, Inc.), SURFYNOL® 440 (Air Products and Chemicals, Inc.), SURFYNOL® 465 (Air Products and Chemicals, Inc.), SURFYNOL® 485 (Air Products and Chemicals, Inc.), MAPHOS® 58 ESTER (BASF), MAPHOS® 60 A Surfactant (BASF), MAPHOS® 66H ESTER (BASF), MAPHOS® 8135 ESTER (BASF), MAPHOS® M-60 ESTER (BASF), 6660 K Hydrotroping Phosphate Ester Salt (Burlington Chemical), Burofac 7580 Aromatic Phosphate Ester (Burlington Chemical), and Burofac 9125 (Burlington Chemical), and mixtures thereof.

In one specific embodiment, the hydrotropic agent may be one or more aromatic phosphate esters, such as, for example, an aromatic phosphate ester having the formula:

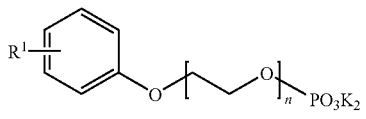

wherein $R^1$ is a $C_1$-$C_5$ linear or branched alkyl group and n=1 to 8.

Suitable dispersants having flocculating characteristics may include, for example, one or more of sodium acid pyrophosphate, tetrapotassium pyrophosphate, monosodium phosphate ($H_6NaO_6P$), monoammonium phosphate ($(NH_4)PO_4$), sodium acid phosphate, trisodium phosphate, sodium tripolyphosphate, sodium trimetaphosphate, sodium laurel phosphate, sodium phosphate, pentapotassium triphosphate, potassium triphosphate, tetraborate potassium tripolyphosphate, potassium phosphate—monobasic, potassium phosphate—dibasic, monopotassium phosphate, and tripotassium phosphate, and mixtures thereof. In one specific embodiment, the dispersant having flocculating characteristics may include one or more pyrophosphate salts, including, for example, one or more of sodium acid pyrophosphate and tetrapotassium pyrophosphate.

In certain embodiments, the hydrotropic agent may be present in the amount of from about 0.1% to about 4.0% by weight of the separating composition. In other embodiments, the hydrotropic agent may be present in an amount of from about 0.1% to about 2%, from about 0.5% to about 4.0%, from about 0.5% to about 2%, from about 1% to about 2%, or from about 1% to about 4.0% by weight of the separating composition. The dispersant having flocculating characteristics may be present in the amount of from about 0.25% to about 4.5% by weight of the separating composition. In other embodiments, the dispersant having flocculating characteristics may be present in an amount from about 0.25% to about 2.5%, from about 0.25% to about 1%, from about 1% to about 4.5%, from about 1% to about 3% or from about 1% to about 2.5% by weight of the separating composition.

In one embodiment, the separating composition may further comprise a strong base, such as, for example, hydroxides of alkali metals and alkaline earth metals, such as, for example, NaOH, KOH, $Ba(OH)_2$, CsOH, SrOH, $Ca(OH)_2$, LiOH, RbOH, NaH, LDA, and $NaNH_2$. As used herein, a "strong base" is a chemical compound having a pH of greater than about 13. The strong base may be present in the amount of from about 2% to about 9.5% by weight of the separating composition. In other embodiments, the strong base may be present in an amount of from about 2% to about 7%, from about 2% to about 5%, from about 4% to about 7% or from about 4% to about 5% by weight of the separating composition.

In one embodiment, the separating composition may further comprise a heavy acid, such as, for example, phosphoric acid, nitric acid, sulfuric acid, hydronic acid, hydrobromic acid, perchloric acid, fluoromatic acid, magic acid ($FSO_3HSbF_5$), carborane super acid [$H(CHB_{11}Cl_{11})$], triflic acid, ethanoic acid, and acetylsalicylic acid. As used herein, a "heavy" acid is an acid having a specific gravity greater than about 1.5. In certain embodiments it may be preferred to use an acid with a specific gravity of greater than about 1.65. The heavy acid may be present in the amount of from about 1.7% to about 8.6% by weight of the separating composition. In other embodiments, the heavy acid may be present in an amount of from about 2% to about 7%, from about 2% to about 5%, from about 4% to about 7% or from about 4% to about 5% by weight of the separating composition.

In one embodiment, the pH of the separating composition may be greater than 7.5. The pH of the separating composition may also be from about 7.0 to about 8.5. The pH of the separating composition may also be from about 7.4 to about 8.5 or from about 7.4 to about 7.8. The pH of the separating composition may also be from about 7.6 to about 7.8.

In another embodiment, the composition may be essentially free of organic solvent. As used herein, the term "organic solvent" refers to solvents that are organic compounds and contain carbon atoms such as, for example, naphtha, benzene, and other hydrocarbon solvents.

In addition to the separating composition, the composition may also comprise hydrocarbon containing materials, such as oil sands, tailings, sludge, and the like (i.e., bitumen-containing compositions). The ratio of the separating composition to the hydrocarbon containing materials may be from about 2:3 to about 1000:1, from about 2:3 to about 500:1, from about 2:3 to about 100:1, from about 2:3 to about 10:1, from about 2:3 to about 3:2, from about 2:3 to about 3:1, or about 1:1.

In yet another embodiment, a separating composition is provided, comprising from about 0.1% to about 4.0%, from about 0.1% to about 2%, from about 0.5% to about 4.0%, from about 0.5% to about 2%, from about 1% to about 2% or from about 1% to about 4.0% by weight of a hydrotropic agent; and from about 0.25% to about 4.5%, from about 0.25% to about 2.5%, from about 0.25 to about 1%, from about 1% to about 4.5%, from about 1% to about 3% or from about 1% to about 2.5% by weight of a dispersant having flocculating characteristics. The separating composition may have a pH of greater than 7.5; from about 7.0 to about 8.5; from about 7.4 to about 8.5, from about 7.4 to about 7.8 or from about 7.6 to about 7.8. The hydrotropic agent may be, for example, MAPHOS® 66H aromatic phosphate ester. The dispersant having flocculating characteristics may be, for example, one or more of sodium acid pyrophosphate and tetrapotassium pyrophosphate.

The separating composition may further comprise a strong base, which may be, for example, sodium hydroxide. The strong base may be present in the amount of from about 2% to about 9.5%, from about 2% to about 7%, from about 2% to about 5%, from about 4% to about 7% or from about 4% to about 5% by weight of the separating composition. The separating composition may further comprise a heavy acid, which may be, for example, phosphoric acid. The heavy acid may be present in the amount of from about 1.7% to about 8.6%, from about 2% to about 7%, from about 2% to about 5%, from about 4% to about 7% or from about 4% to about 5% by weight of the separating composition. The separating composition may also be essentially free or completely free of organic solvent.

In one embodiment, a separating composition for separating bitumen from oil sands or tailings is provided, comprising from about 0.1% to about 4.0%, from about 0.1% to about 2%, from about 0.5% to about 4.0%, from about 0.5% to about 2%, from about 1% to about 2% or from about 1% to about 4.0% by weight of an aromatic phosphate ester having the formula:

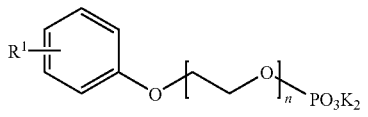

wherein $R^1$ is a $C_1$-$C_5$ linear or branched alkyl group and n=1 to 8; from about 0% to about 4.5%, from about 0.25% to about 4.5%, from about 0.25% to about 2.5%, from about 0.25 to about 1%, from about 1% to about 4.5%, from about 1% to about 3% or from about 1% to about 2.5% by weight of sodium pyrophosphate; from about 0% to about 4.5%, from about 0.25% to about 4.5%, from about 0.25% to about 2.5%, from about 0.25 to about 1%, from about 1% to about 4.5%, from about 1% to about 3% or from about 1% to about 2.5% by weight of tetrapotassium pyrophosphate; from about 2% to about 9.5%, from about 2% to about 7%, from about 2% to about 5%, from about 4% to about 7% or from about 4% to about 5% by weight of sodium hydroxide; and from about 1.7% to about 8.6%, from about 2% to about 7%, from about 2% to about 5%, from about 4% to about 7% or from about 4% to about 5% by weight of phosphoric acid. The separating composition may have a pH of from about 7.0 to about 8.5, from about 7.4 to about 8.5, from about 7.4 to about 7.8 or from about 7.6 to about 7.8. The separating composition may also be essentially free of organic solvent.

In one embodiment, a method for separating bitumen from oil sands is provided, comprising contacting a separating composition comprising a hydrotropic agent and a dispersant having flocculating characteristics with oil sands comprising bitumen and sand; heating the separating composition and the oil sands; agitating the separating composition and the oil sands; and recovering the bitumen and sand as separate products. The pH of the separating composition may be greater than 7.5; from about 7.0 to about 8.5; from about 7.4 to about 8.5, from about 7.4 to about 7.8 or from about 7.6 to about 7.8.

In one embodiment, the separating composition used in the exemplary method may be comprised of from about 0.1% to about 4.0% by weight of a hydrotropic agent; and from about 0.25% to about 4.5% by weight of a dispersant having flocculating characteristics.

In another embodiment, the separating composition used in the exemplary method may be comprised of from about 0.1% to about 4.0% by weight of an aromatic phosphate ester having the formula:

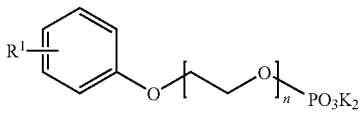

wherein $R^1$ is a $C_1$-$C_5$ linear or branched alkyl group and n=1 to 8; from about 0% to about 4.5% by weight of sodium pyrophosphate; from about 0% to about 4.5% by weight of tetrapotassium pyrophosphate; from about 2% to about 9.5% by weight of sodium hydroxide; and from about 1.7% to about 8.6% by weight of phosphoric acid.

With respect to the process conditions under which the exemplary method may be carried out, the separating composition and the oil sands may be heated to greater than 25° C. (77° F.); from about 32° C. (90° F. to about 72° C. (162° F.); or from about 54° C. (129° F.) to about 60° C. (140° F.). Any source of heat within the ambit of those skilled in the art may be used. Similarly, any device capable of providing sufficient agitation to achieve high shear may be used to agitate the separating composition and the oil sands (or other bitumen-containing or hydrocarbon-containing composition or material), including, for example, a high shear mixer, high speed attritor, high speed dispersers, fluidized beds, sonic-based mixers and the like, or any other device capable of providing sufficient agitation within the ambit of those skilled in the art. Sufficient agitation is defined herein as agitation (or mixing) that is adequate to achieve high shear or to disperse the separating solution throughout the particles of the bitumen containing composition such that upon ceasing agitation of the mixed slurry, at least 99% of the bitumen present in the bitumen containing composition separates out of the slurry and will have floated to the top to form a bitumen layer in 5 minutes or less at a slurry temperature of about 140° F. and the bitumen layer contains less than 2% by weight of solids (i.e., sand and clay). As used herein, high shear is also defined as sufficient mechanical dispersion of all particles (including particles of colloidal size 5-200 nanometers) within a mixture so that such particles are separated substantially evenly throughout the mixture. Such a mixture will have a monolithic appearance, or described differently will appear to be consistent in composition and will lack streaks, globs or separate discernible agglomerations of hydrocarbon-containing material such as oil sands.

In one embodiment, the ratio of the separating composition to the oil sands may be from about 2:3 to about 3:2. In other embodiments, the ratio of the separating composition to the oil sands may be from about 2:3 to about 1000:1, from about 2:3 to about 500:1, from about 2:3 to about 100:1, from about 2:3 to about 10:1, from about 2:3 to about 3:2, from about 2:3 to about 3:1, or about 1:1.

The recovered bitumen may be essentially emulsion-free. The exemplary method may be performed without the addition of organic solvent.

In some circumstances, it may prove desirable to subject the separated, recovered bitumen to a second or subsequent aliquot of separating composition. In such a case, the exemplary method further comprises contacting the separated, recovered bitumen with a second or subsequent aliquot of fresh separating composition; heating the fresh separating composition and the bitumen; agitating the fresh separating composition and the recovered bitumen; and recovering the resulting bitumen. Such a "rinse" cycle may be repeated until the bitumen is essentially free of any sand or other particulate matter.

In another embodiment, the separating composition may be recyclable. Thus, the exemplary method further comprises recovering the separating composition; contacting the recovered separating composition with a second or subsequent aliquot of oil sands comprising bitumen and sand; heating the recovered separating composition and the second or subsequent aliquot of oil sands; agitating the recovered separating composition and the second or subsequent aliquot of oil sands; and recovering the bitumen and sand as separate products. The recycled or recovered separating composition may also be utilized for a rinse or second treatment of the recovered bitumen.

In another embodiment, a method is disclosed for processing existing tailings, both to salvage remaining bitumen and to allow for redeposit of the essentially bitumen-free sand. The method may comprise contacting a separating composition comprising a hydrotropic agent and a dispersant having flocculating characteristics with tailings comprising bitumen and sand; heating the separating composition and the tailings; agitating the separating composition and the tailings; and recovering the bitumen and sand as separate products. The pH of the separating composition may be greater than 7.5; from about 7.0 to about 8.5; from about 7.4 to about 8.5; from about 7.4 to about 8.5; from about 7.4 to about 7.8; or from about 7.6 to about 7.8.

In one embodiment, the separating composition used in the exemplary method for processing existing tailings may be comprised of from about 0.1% to about 4.0% by weight of a hydrotropic agent; and from about 0.25% to about 4.5% by weight of a dispersant having flocculating characteristics. In other embodiments, the separating composition may be comprised of from about 0.1% to about 2%, from about 0.5% to about 4.0%, from about 0.5% to about 2%, from about 1% to about 2% or from about 1% to about 4.0% by weight of a hydrotropic agent; and from about 0.25% to about 2.5%, from about 0.25 to about 1%, from about 1% to about 4.5%, from about 1% to about 3% or from about 1% to about 2.5% by weight of a dispersant having flocculating characteristics.

In another embodiment, the separating composition used in the exemplary method for processing existing tailings may be comprised of from about 0.1% to about 4.0% by weight of an aromatic phosphate ester having the formula:

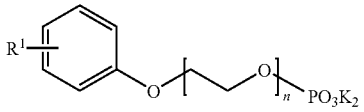

wherein $R^1$ is a $C_1$-$C_5$ linear or branched alkyl group and n=1 to 8; from about 0% to about 4.5% by weight of sodium pyrophosphate; from about 0% to about 4.5% by weight of tetrapotassium pyrophosphate; from about 2% to about 9.5% by weight of sodium hydroxide; and from about 1.7% to about 8.6% by weight of phosphoric acid. In other embodiments, the separating composition may be comprised of from about 0.1% to about 2%, from about 0.5% to about 4.0%, from about 0.5% to about 2%, from about 1% to about 2% or from about 1% to about 4.0% by weight of an aromatic phosphate ester having the formula:

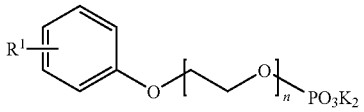

wherein $R^1$ is a $C_1$-$C_5$ linear or branched alkyl group and n=1 to 8; from about 0.25% to about 4.5%, from about 0.25% to about 2.5%, from about 0.25 to about 1%, from about 1% to about 4.5%, from about 1% to about 3% or from about 1% to about 2.5% by weight of sodium pyrophosphate; from about 0.25% to about 4.5%, from about 0.25% to about 2.5%, from about 0.25 to about 1%, from about 1% to about 4.5%, from about 1% to about 3% or from about 1% to about 2.5% by weight of tetrapotassium pyrophosphate; from about 2% to about 7%, from about 2% to about 5%, from about 4% to about 7% or from about 4% to about 5% by weight of sodium hydroxide; and from about 2% to about 7%, from about 2% to about 5%, from about 4% to about 7% or from about 4% to about 5% by weight of phosphoric acid.

With respect to the process conditions under which the exemplary method for processing existing tailings may be carried out, the separating composition and the tailings may be heated to greater than 25° C. (77° F.); from about 32° C. (90° F.) to about 72° C. (162° F.); or from about 54° C. (129° F.) to about 60° C. (140° F.). Any source of heat within the ambit of those skilled in the art may be used. Similarly, any device capable of providing sufficient agitation may be used to agitate the separating composition and the tailings, including, for example, a high shear mixer, high speed attritor, high speed dispersers, fluidized beds, and the like, or any other device capable of providing sufficient agitation within the ambit of those skilled in the art.

In one embodiment, the ratio of the separating composition to the tailings may be from about 2:3 to about 3:2. In another embodiment, ratio of the separating composition to the tailings may be from about 2:3 to about 1000:1, from about 2:3 to about 500:1, from about 2:3 to about 100:1, from about 2:3 to about 10:1, from about 2:3 to about 3:2, from about 2:3 to about 3:1 or about 1:1.

The recovered bitumen may be essentially emulsion-free. The exemplary method may be performed without the addition of organic solvent.

In one embodiment, a bitumen recovery process may recover at least 99% of the bitumen present in a bitumen containing composition (e.g., oil sands, sludge, tailings, and so on). The exemplary bitumen recovery process does not involve the use of organic solvents, eliminating the need to contend with environmental concerns associated with the use of such solvents. In other embodiments, the use of the separating composition may recover other high percentages of the bitumen present in a bitumen containing composition (e.g., 97%, 98%, 99%, 99.5%).

The exemplary bitumen recovery process may optionally include grinding the bitumen containing composition. For example, grinding has been found to be useful when processing Utah oil sands. Grinding may include granulating or decompacting the bitumen containing composition to a ground composition of a particle size adequate for the machinery performing subsequent steps in the bitumen recovery process. In certain embodiments, the grinding may be used to achieve a ground composition having an average particle size of about 1/16" to about 1/4". Grinding may be performed mechanically using methods and machinery within the ambit of the person having ordinary skill in the art (e.g., grinder, granulator, and so on). Grinding may or may not be necessary depending upon the size of the particles of the bitumen containing composition which can be influenced by the source of the bitumen containing composition (e.g., oil sands), the amount of time during which the bitumen containing composition has been stored and the conditions under which it has been stored (e.g., subjected to high or low temperatures or compaction).

Grinding may further include substantially keeping the ground composition from recompacting by continuously churning or stirring the ground composition. Churning or stirring may be performed by methods and machinery within the ambit of the person having ordinary skill in the art. In one embodiment, the machinery performing the churning or stirring operates at about 2 rpm. In other embodiments, the machinery performing the churning or stirring operates below 2 rpm or above 2 rpm. In one embodiment, the ground composition is churned or stirred in order to maintain workability.

After grinding, the ground composition may be transported or moved to a tank or container. Transporting of the ground composition to the tank or container may be performed using methods and machinery within the ambit of the person having ordinary skill in the art (e.g., conveyor, belt, slide, and so on) to control with some level of precision the ratio at which the ground composition is mixed with a separating composition.

The exemplary bitumen recovery process may further include mixing the ground composition with the separating composition to produce a slurry. In one embodiment, the ground composition and the separating composition are mixed at a ratio of from about 2:3 to about 1000:1, from about 2:3 to about 500:1, from about 2:3 to about 100:1, from about 2:3 to about 10:1, from about 2:3 to about 3:2, from about 2:3 to about 3:1, or about 1:1. Mixing may be performed by methods and machinery within the ambit of the person having ordinary skill in the art (e.g., mixer, blender, and so on). In one embodiment, mixing is performed by a 2 Hp mixer in a tank filled to half capacity.

The separating composition may comprise a hydrotropic agent and a dispersant having flocculating characteristics. In one embodiment, the separating composition may further comprise a wetting agent. In one embodiment, the separating composition may have a pH of from about 7 to about 8.5. In a specific embodiment, the separating compositing may have a pH of from about 7.4 to about 8.5, 7.4 to about 7.8, or from about 7.6 to about 7.8.

With respect to the conditions under which the exemplary bitumen recovery process may be carried out, the ground composition and the separating composition may be heated to greater than 25° C. (77° F.); from about 32° C. (90° F.) to about 72° C. (162° F.); or from about 54° C. (129° F.) to about 60° C. (140° F.). Any source of heat within the ambit of those skilled in the art may be used. In one embodiment, the separating composition may be heated to a temperature of about 77° F. to about 162° F., about 100° F. to about 150° F., or about 130° F. to about 140° F. before adding the ground composition or the bitumen containing composition.

The exemplary bitumen recovery process may further include subjecting the slurry to high speed mixing to produce a mixed slurry. In one embodiment, the slurry is moved or pumped from the tank of container to be subjected to high speed mixing by relatively high speed mixing machinery. High speed mixing may be performed by methods and machinery within the ambit of the person having ordinary skill in the art (e.g. mixer, attritor, disperser, and so on). In one embodiment, high speed mixing is performed by machinery with blades that operate at a blade tip speed of 27 meters per second. In other embodiments, high speed mixing is performed by machinery with blades that operate at a blade tips speed of less than 27 meters per second. In one embodiment, the blades of the high speed mixing machinery are coated to extend their life. The coating may be selected from various known in the art (e.g., tungsten carbide, ceramic, and so on).

In one embodiment, the slurry is subjected to aeration before or during mixing. Air may be injected into the slurry to make the slurry lighter, and thus easier to mix, and to promote bitumen floatation later in the bitumen recovery process.

In one embodiment, the high speed mixing may include two or more mixing speeds. The slurry may first be mixed at a relatively low shear (e.g., a tip speed of 6 feet per second) and allowed to settle so that a portion of the sand flocculates to the bottom of the mixture. In certain embodiments, at least 50% of the sand flocculates to the bottom. In other embodiments, at least 75% or at least 90% of the sand flocculates to the bottom. The portion of sand at the bottom is removed. The sand may be removed intermittently (i.e., while continuing the mixing of the slurry) or after a certain amount accumulates and the mixing container is emptied of slurry. The remaining slurry may then be mixed at a relatively high shear. In a "high shear" mixer, large forces are transmitted to the substances being mixing with results in a relatively shorter and efficient mixing process between the particles of the separate substances (in this case the separating composition and the bitumen containing composition.) High shear is achieved with an amount of mixing or agitation that is adequate to disperse the separating solution throughout the particles of the bitumen containing composition such that upon ceasing agitation of the mixture, at least 99% of the bitumen present in the bitumen containing composition separates out of the slurry and will have floated to the top to form a bitumen layer in 5 minutes or less at a slurry temperature of about 140° F. and the bitumen layer contains less than 2% by weight of solids (i.e., sand and clay). Similarly, any device capable of providing sufficient agitation to achieve high shear may be used to agitate the separating composition and the oil sands (or other bitumen-containing or hydrocarbon-containing composition or material), including, for example, a high shear mixer, high speed attritor, high speed dispersers, fluidized beds, sonic-based mixers and the like, or any other device capable of providing sufficient agitation within the ambit of those skilled in the art. Sufficient agitation is defined herein as agitation (or mixing) that is adequate to achieve high shear or to disperse the separating solution throughout the particles of the bitumen containing composition such that upon ceasing agitation of the mixed slurry, at least 99% of the bitumen present in the bitumen containing composition separates out of the slurry and will have floated to the top to form a bitumen layer in 5 minutes or less at a slurry temperature of about 140° F. and the bitumen layer contains less than 2% by weight of solids (i.e., sand and clay). As used herein, high shear is also defined as sufficient mechanical dispersion of all particles (including particles of colloidal size 5-200 nanometers) within a mixture so that such particles are separated substantially evenly throughout the mixture. Such a mixture will have a monolithic appearance, or described differently will appear to be consistent in composition and will lack streaks, globs or separate discernible agglomerations of hydrocarbon-containing material such as oil sands. A multiple speed process may extend the life of the mixing blades.

The exemplary bitumen recovery process may further include allowing the mixed slurry to separate into at least three separate layers comprising a bitumen layer, a separating composition layer, and a solids layer. In one embodiment, the high speed mixed slurry is moved or discharged to a tank or vessel where the at least three separate layers may be allowed to separate. The bitumen layer floats to the top and the solids layer flocculates to the bottom with the separating composition layer in between. In one embodiment, the solids layer consists essentially of sand and clay. The solids layer may be substantially removed from the bottom of the tank or vessel by methods and machinery within the ambit of the person having ordinary skill in the art (e.g., conveyor, belt, thickener, and so on).

The exemplary bitumen recovery process further includes removing the bitumen layer. The bitumen layer may be substantially removed from the tank or vessel by methods (e.g., skimming, decanting, suctioning, and so on) and machinery (e.g., belt skimmer, drum skimmer, oleophilic skimmer, suction device and so on) within the ambit of the person having ordinary skill in the art. In one embodiment, the process of removing the bitumen layer may include heating the bitumen (to about 100° F. to about 150° F.) to achieve or maintain the necessary viscosity for the skimming machinery to satisfactorily remove the bitumen layer from the tank or vessel.

In one embodiment, the removed bitumen contains 2% by weight or less solids, and has a viscosity of about 4000 to 6000 cps at 140° F. In other embodiments, the removed bitumen contains 1% by weight or less of solids.

The exemplary bitumen recovery process may further include a polishing or rinse process including mixing the bitumen removed in the bitumen layer with additional separating composition to produce a second mixture. In one embodiment, the ratio of removed bitumen to separating composition in the second mixture is from about 2:3 to about 1000:1, from about 2:3 to about 500:1, from about 2:3 to about 100:1, from about 2:3 to about 10:1, from about 2:3 to about 3:2, from about 2:3 to about 3:1, or about 1:1. The second mixture may be subjected to high speed mixing and high shear conditions. High speed mixing may be performed by methods and machinery within the ambit of the person having ordinary skill in the art (e.g., mixer, attritor, disperser, and so on).

The polishing process may further include allowing the second mixture to separate into at least three separate layers comprising a second bitumen layer, a second separating composition layer and a second solids layer. The second bitumen layer floats to the top and the second solids layer flocculates to the bottom with the second separating composition layer in between.

The second solids layer may be substantially removed from the bottom of the tank or vessel by methods and machinery within the ambit of the person having ordinary skill in the art (e.g., conveyor, belt, thickener, centrifuge, and so on). The second bitumen layer may be substantially removed from the tank or vessel by methods (e.g., skimming, decanting, suctioning and so on) and machinery (e.g., belt skimmer, drum skimmer, oleophilic skimmer, suctioning device and so on) within the ambit of the person having ordinary skill in the art. In one embodiment, the process of removing the bitumen layer may include heating the bitumen (to about 100° F. to about 150° F.) to achieve or maintain the necessary viscosity for the skimming machinery to satisfactorily remove the bitumen from the bitumen layer.

In one embodiment, the bitumen removed during the polishing process contains at least 99% by weight of the bitumen present in the bitumen containing composition and is at least 99% free of clay and sand. In other embodiments, the bitumen removed during the polishing process contains at least 98% or at least 97% by weight of the bitumen present in the bitumen containing composition and is at least 99% free of clay and sand. In still other embodiments, the bitumen removed during the polishing process contains at least 99.5% of the bitumen present in the bitumen containing composition and is at least 99% free of clay and sand.

In one embodiment, the exemplary bitumen recovery process may include recycling the separating composition from the separating composition layer or the second separating composition layer. The recycled separating composition may be reused in the bitumen recovery process and mixed with additional bitumen containing composition.

In one embodiment, the exemplary bitumen recovery process is a continuous process. In another embodiment, the exemplary bitumen recovery process is a batch process.

The present embodiments have been described mainly in the context of lab or pilot plant-scale results. However, it should be appreciated that the results described herein are meant to embody the entire process by which oil sands are obtained, the extraction of bitumen from the oil sands, and the further processing of the extracted bitumen. By way of example, mining shovels dig oil sand ore and load it into trucks or other transportation means. The trucks take the oil sands to crushers where the oil sands are broken down in size. The broken down oil sands are added to a mixing tank and contacted with the separating composition as described herein. The separated bitumen is augered and pumped to storage, and then further refined to produce synthetic crude oil suitable for use as a feedstock for the production of liquid motor fuels, heating oil, and petrochemicals.

The following examples are provided to illustrate various embodiments and shall not be considered as limiting in scope.

Example 1(a)

Separation of Bitumen from Athabasca Oil Sands

TABLE 1(a)

| | |
|---|---|
| 265.197 g | $H_2O$ |
| 13.5 g | Phosphoric acid 75% |
| 0.75 g | Sodium acid pyrophosphate |
| 15 g | Caustic soda 50% |
| 4.8 g | Tetrapotassium pyrophosphate 60% |
| 0.75 g | MAPHOS ® 66 H ESTER |
| 0.003 g | DYNOL ® 607 Surfactant |

The beaker containing the separating composition (Composition 1(a) was charged with 300 g of Athabasca oil sands. The resultant slurry was heated to between 54° C. and 60° C. A high shear lab mixer was lowered into the beaker and the slurry was stirred at 3500 rpm for 3 minutes. The mixer was removed from the beaker Over the course of the next 5-30 minutes, complete phase separation occurred within the beaker Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker. The bitumen was determined to be greater than 99% free of contaminants, including sand and clay. Approximately 45 g of bitumen was recovered, representing greater than 99% of all of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 100.00 g of the dried sand was placed in a beaker. 100 g of toluene was added to the sand. The resultant slurry was agitated, then allowed to settle. The toluene was decanted from the sand. The decanted toluene was visually inspected and found to be clear. The sand was dried again at 72° C. for 8 hours to evaporate any remaining toluene. Thereafter, the sand was weighed 99.86 g of sand remained.

In a separate 1 L beaker was placed a fresh 300 g aliquot of the separating composition. To the fresh separating composition was added 45 g of the separated, recovered bitumen. The separating composition and the bitumen were heated to 72° C. and were stirred at 2000 rpm for 3 minutes. The beaker contents were allowed to cool and were separated as described above. The resultant bitumen was effectively completely free of contaminants.

The original separating composition was removed from the first 1 L beaker after the bitumen was removed. 275 g of this separating composition was added to a 1 L beaker. The beaker was charged with 275 g of a new aliquot of Athabasca oil sands. The slurry was heated to 72° C. and was stirred at 3000 rpm for 3 minutes.

The beaker contents were allowed to cool, at which time the bitumen was removed from the beaker. The bitumen was determined to be greater than 99% free of contaminants, including sand and clay. Approximately 41 g of bitumen was recovered, representing greater than 99% of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 100.00 g of the dried sand was placed in a beaker. 100 g of toluene was added to the sand. The resultant slurry was agitated, then allowed to settle. The toluene was decanted from the sand. The decanted toluene was visually inspected and found to be clear. The sand was dried again at 72° C. for 8 hours to evaporate any remaining toluene. Thereafter, the sand was weighed. 99.83 g of sand remained.

Example 1(b)

Separation of Bitumen from Athabasca Oil Sands 300 g of the following separating composition was prepared and placed in a 1 L beaker:

Composition 1(b)

TABLE 1(b)

| | |
|---|---|
| 270.84 g | $H_2O$ |
| 10.8 g | Phosphoric acid 75% |
| 1.20 g | Sodium acid pyrophosphate |
| 13.44 g | Caustic soda 50% |
| 3.12 g | Tetrapotassium pyrophosphate 60% |
| 0.60 g | MAPHOS ® 66 H ESTER |

The beaker containing Composition 1(b) was charged with 300 g of Athabasca oil sands. The resultant slurry was heated to between 54° C. and 60° C. A high shear lab mixer was lowered into the beaker and the slurry was stirred at 3500 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker by use of a spoon (although other physical separation means such as decanting or the use of a syringe or other suction device could also be utilized. The bitumen was determined to be greater than 99% free of contaminants, including sand and clay. Approximately 45 g of bitumen was recovered, representing greater than 99% of all of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 255 g of the dried sand was placed in a beaker. 255 g of toluene was added to the sand. The resultant slurry was agitated, then allowed to settle. The toluene was then decanted from the sand. The decanted toluene was visually inspected and found to be clear. The sand was dried again at 72° C. for 8 hours to evaporate any remaining toluene. Thereafter, the sand was weighed, and 255 g of sand remained.

Example 2(a)

Separation of Bitumen from Athabasca Tailings Pond 200 g of the separating composition was prepared as in Example 1(a). The separating composition was placed in a 1 L beaker. The beaker was charged with 300 g of tailings from an Athabasca tailings pond. The slurry was heated to 72° C. and was stirred at 3000 rpm for 2 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker. The bitumen was determined to be greater than 99% free of contaminants, including sand and clay. Approximately 12 g of bitumen was recovered, representing greater than 99% of the available bitumen in the sample of tailings.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 100.00 g of the dried sand was placed in a beaker. 100 g of toluene was added to the sand. The resultant slurry was agitated, then allowed to settle. The toluene was decanted from the sand. The decanted toluene was visually inspected and found to be clear. The sand was dried again at 72° C. for 8 hours to evaporate any remaining toluene. Thereafter, the sand was weighed. 99.76 g of sand remained.

Example 2(b)

Separation of Bitumen from Utah Oil Sands 300 g of the following separating composition was prepared and placed in a 1 L beaker:

Composition 2(b)

TABLE 2(b)

| | |
|---|---|
| 263.55 g | $H_2O$ |
| 13.55 g | Phosphoric acid 75% |
| 1.50 g | Sodium acid pyrophosphate |
| 16.80 g | Caustic soda 50% |
| 3.90 g | Tetrapotassium pyrophosphate 60% |
| 0.75 g | MAPHOS ® 66 H ESTER |

The beaker containing Composition 2 was charged with 300 g of Utah oil sands. The resultant slurry was heated to between 54° C. and 60° C. A high shear lab mixer was lowered into the beaker and the slurry was stirred at 3500 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker by use of a spoon (although other physical separation means such as decanting or the use of a syringe or other suction device could also be utilized. The bitumen was determined to be greater than 99% free of contaminants, including sand and clay. Approximately 40 g of bitumen was recovered, representing greater than 99% of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 266 g of the dried sand was placed in a beaker. 266 g of toluene was added to the sand. The resultant slurry was agitated, then allowed to settle. The toluene was then decanted from the sand. The decanted toluene was visually inspected and found to be clear. The sand was dried again at 72° C. for 8 hours to evaporate any remaining toluene. Thereafter, the sand was weighed, and 266 g of sand remained.

Example 2(c)

Separation of Bitumen from Utah Tailings Pond 300 g of the separating composition was prepared as in Example 1(a). The separating composition was placed in a 1 L beaker. The beaker was charged with 300 g of tailings from a Utah tailings pond. The slurry was heated to 72° C. and was stirred at 3000 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker. The bitumen was determined to be greater than 99% free of contaminants, including sand and clay. Approximately 4 g of bitumen was recovered, representing greater than 99% of the available bitumen in the sample of tailings.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 100.00 g of the dried sand was placed in a beaker. 100 g of toluene was added to the sand. The resultant slurry was agitated, then allowed to settle. The toluene was decanted from the sand. The decanted toluene was visually inspected and found to be clear. The sand was dried again at 72° C. for 8 hours to evaporate any remaining toluene. Thereafter, the sand was weighed. 99.77 g of sand remained.

Example 2(d)

Separation of Bitumen from Utah Oil Sands 300 g of the separating composition was prepared as in Example 1(a) and was placed in a 1 L beaker. The beaker containing the separating composition was charged with 300 g of Utah oil sands. The resultant slurry was heated to between 54° C. and 60° C. A high shear lab mixer was lowered into the beaker and the slurry was stirred at 3500 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker. The bitumen was determined to be greater than 99% free of contaminants, including sand and clay. Approximately 40 g of bitumen was recovered, representing greater than 99% of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

In a separate 1 L beaker was placed a fresh 300 g aliquot of the separating composition. To the fresh separating composition was added 40 g of the separated, recovered bitumen. The separating composition and the bitumen were heated to 72° C. and were stirred at 2000 rpm for 3 minutes. The beaker contents were allowed to cooled and separated occurred as described above. The resultant bitumen was effectively completely free of contaminants.

The original separating composition was removed from the first 1 L beaker after the bitumen was removed. 275 g of this separating composition was added to a 1 L beaker. The beaker was charged with 275 g of a new aliquot of Utah oil sands. The slurry was heated to 72° C. and was stirred at 3000 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker. The bitumen was determined to be greater than 99% free of contaminants, including sand and clay. Approximately 44 g of bitumen was recovered, representing greater than 99% of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 100.00 g of the dried sand was placed in a beaker. 100 g of toluene was added to the sand. The resultant slurry was agitated, then allowed to settle. The toluene was decanted from the sand. The decanted toluene was visually inspected and found to be clear. The sand was dried again at 72° C. for 8 hours to evaporate any remaining toluene. Thereafter, the sand was weighed. 99.85 g of sand remained.

Example 3

Preparation of Separating Composition Using River Water

River water from the Athabasca River located in northern Alberta province, Canada ("River Water") was provided from Canada. 800 g of separating composition was made using the River Water and according to a standard formula (provided below in Table 3). 210 g of the separating composition was mixed with 90 g of Canadian Oil Sands (from the Athabasca region in northern Alberta province, Canada). Prior to mixing with the Canadian Oil Sands, the pH of the separating composition was adjusted to 7.76 using phosphoric acid.

The mixture of the separating composition and Canadian Oil Sands was placed into a Mason jar. The samples were heated to 140° F. (about 61° C.) using a microwave oven. After heating, in order to disperse the mixture, a 10,000 rpm high speed disperser with 1" blade was utilized. A Premier Mill, Series 2000, Model 2000, 110 V, 1 horsepower, 12 amp bench top disperser was utilized as the high speed disperser. The disperser was utilized for approximately 3 minutes. Thereafter, as the sample sat in place the constituents settled and distinct layers began to form. Within a half hour three distinct layers had formed with bitumen in the top layer, the used separating composition in the second layer, and solids (e.g., sand and clay) in the third layer. The result achieved in terms of the separating into three distinct layers appeared to be almost exactly as a control (made using Deionized Water) indicating that the River Water would be acceptable for use in preparing the separating composition with no need for pre-treatment.

After the Mason Jar contents had cooled and the three distinct layers had formed (approximately 1 hour), the bitumen was removed from the Mason Jar by use of a spoon (although other physical separation means such as decanting or the use of a syringe or other suction device could also be utilized. The bitumen was determined to be greater than 99% free of contaminants, including sand and clay. Approximately 9 g of bitumen was recovered, representing greater than 99% of all of the available bitumen in the sample of Canadian Oil Sands.

TABLE 3

| Amount (grams) | Ingredient |
|---|---|
| 184 | Water |
| 9.45 | Phosphoric acid (75%) |
| 1.05 | Sodium acid pyrophosphate |
| 11.7 | Caustic soda (50%) |
| 2.73 | Tetrapotassium pyrophosphate (60%) |
| 0.52 | MAPHOS ® 66 H ESTER |

Example 4

Preparation of Separating Composition with Process Water

Process water (or recirculation water) utilized in the processing of Athabasca oil sands was provided from Canada ("Process Water"). The Process Water was brown-colored and appeared to contain clay suspended in an emulsion. 800 g of separating composition was made using the Process Water according to the standard formula provided above in Table 1(b). The separating composition was allowed to sit for a hour during which time all or substantially all of the clay in the Process Water flocculated out and settled. After flocculation and settling had occurred, the separating solution was decanted away from the flocculated clay. Thereafter, the separating composition was adjusted to a pH of 7.76 (using phosphoric acid) and then 210 g of the separating composition was mixed with 90 g of Canadian Oil Sands (from the Athabasca region in northern Alberta province, Canada).

The mixture of the separating composition and the Canadian Oil Sands was placed into a Mason jar. The samples were heated to 140° C. using a microwave oven. After heating, in order to disperse the mixture, a 10,000 rpm high speed disperser with 1" blade was utilized. A Premier Mill, Series 2000, Model 2000, 110 V, 1 horsepower, 12 amp bench top disperser was utilized as the high speed disperser. The disperser was utilized for approximately 3 minutes. Thereafter, as the sample sat in place the constituents settled and distinct layers began to form. Within a half hour three distinct layers had formed with bitumen in the top layer, the used separating composition in the second layer, and solids (e.g., sand and clay) in the third layer. The reaction was almost exactly as the control indicating that the Process Water would be acceptable for use in preparing the separating composition with no need for pre-treatment.

After the Mason Jar contents had cooled and the three distinct layers had formed (approximately 1 hour), the bitumen was removed from the Mason Jar by use of a spoon (although other physical separation means such as decanting or the use of a syringe or other suction device could also be utilized. The bitumen was determined to be greater than 99% free of contaminants, including sand and clay. Approximately 9 g of bitumen was recovered, representing greater than 99% of all of the available bitumen in the sample of Canadian Oil Sands.

Example 5

Separation of Bitumen Tailings Ponds MFT (Mature Fine Tailings 30% Sample)

800 g of separating composition was made with River Water, as provided above in Example 3. A sample of mature fine tailings from a tailings pond in the Athabasca region of Northern Alberta province, Canada, ("MFT Pond Sample")

was provided from Canada. Generally, mature fine tailings consist of an emulsion of solids (e.g., sand and clay), bitumen and water and while varying in age can be several decades old (e.g., 10 years, 20 years, 30 years, 40 years). The MFT Pond Sample contained approximately 30% solids (sand, clay and bitumen) and approximately 70% water and was thick, viscous and dark in color with a pungent odor (believed to be from the presence of anaerobic bacteria). Again, 210 g of the separating composition was utilized and this time mixed with 90 g of the MFT Pond Sample. Prior to mixing with the Canadian Oil Sands, the pH of the separating composition was adjusted to 7.8 using phosphoric acid.

The mixture of the separating composition and Canadian Oil Sands was placed into a Mason jar. The samples were heated to 140° C. using a microwave oven. After heating, in order to disperse the mixture, a 10,000 rpm high speed disperser with 1" blade was utilized. A Premier Mill, Series 2000, Model 2000, 110 V, 1 horsepower, 12 amp bench top disperser was utilized as the high speed disperser. The disperser was utilized for approximately 3 minutes.

Thereafter, as the sample sat in place the constituents settled and distinct layers began to form within about 15 minutes. Within a half hour three distinct layers had formed with bitumen in the top layer, the used separating composition in the second layer, and solids (e.g., sand and clay) in the third layer. Complete settling of the solids (and separation into distinct layers) took relatively longer than in Examples 4 and 5 due to the amount of solids (e.g., clay) present in the MFT Pond Sample.

After the Mason Jar contents had cooled and the three distinct layers had formed (approximately 12 hours), the bitumen was removed from the Mason Jar by use of a spoon (although other physical separation means such as decanting or the use of a syringe or other suction device could also be utilized. The bitumen was determined to be greater than 99% free of contaminants, including sand and clay. Approximately 2.8 g of bitumen was recovered, representing greater than 99% of all of the available bitumen in the sample of Canadian Oil Sands. The amount of bitumen recover represented approximately 3% of the weight of the MFT Pond Sample or approximately 10% of the weight of the solids present in the MFT Pond Sample.

Example 6

Scalable Bitumen Recovery Process

A scalable bitumen recovery system was built and tested to recover more than 99% of the bitumen present in a bitumen containing composition, in this case oil sands from Canada.

The first step in the process was to grind the oil sands to a size adequate for the machinery performing subsequent steps in the process. Grinding was performed using a granulator. The ground oil sands were kept from recompacting by churning the ground oil sands at about 2 rpm and 15,000 ft pounds of torque on a second machine called a sandulator. A hydraulic conveyor at the bottom of the sandulator was used to feed the ground oil sands into a slurry tank containing a separating composition with a pH from 7.4 to 7.8 prepared according to the ingredient ratios disclosed above in Table 3. The slurry tank was a 400 gallon tank and was kept at about half capacity to promote good mixing. The mixture of oil sands and separating composition were heated to about 140° F. in the slurry tank through the use of a steam heat exchanger. A 2 horse power mixer (from Lightnin) was used to mix the slurry. The oil sands and the separating composition were mixed at a 1:1 ratio. The process was operated as a continuous flow process. The slurry pump operated at about 22-23 gallons per minute and a volume of about 220 gallons was maintained in the tank. (Thus, the average dwell time of the slurry was about 10 minutes.)

The slurry was then pumped (using a Deming model #400110400 7.5 horsepower pump equipped with a 6 inch impeller and operated at 1720 rpm) to an attritor disperser (made by Lightnin) consisting of two 50 liters vessels. The slurry was fed into the vessels at about 22-23 gallons per minute. Each vessel had two high shear blades of 12 inches in diameter. The slurry in the vessels was subjected to aeration at 20 cf/Hr. The slurry was kept at about 140° F. by use a steam heated heat exchanger. The slurry was then mixed at about 1750 rpm, with a tip speed of 27 meters per second. The attritor dispersers discharged into another vessel, the Primary Separation Vessel. This vessel was a rectangular shaped 3,000 gallon tank. The slurry was then allowed to separate.

Almost immediately upon entering the Primary Separation Vessel, bitumen began to rise to the top of the tank. Within a relatively short period of time (e.g., about 20 minutes), the slurry had separated into three separate layers comprising a bitumen layer, a separating composition layer, and a solids layer. (In certain embodiments, the solids layer may consist of separate layers of sand and clay.) The solids layer, consisting mostly of sand and clay, flocculated to the bottom of the tank. The solids layer was removed from the bottom of the tank or vessel by means of a conveyor at the bottom of the Primary Separation Vessel. At least 99% of the bitumen present in the bitumen containing composition had separated out of the slurry and floated to the top to form a bitumen layer within 5 minutes.

The bitumen layer began to floated to the top of the tank almost immediately upon entering the Primary Separation Vessel. Once a layer of bitumen had formed on the surface of the tank, bitumen removal began using a belt skimmer. The bitumen removed had a viscosity of about 4000 to 6000 cps at 140° F. The skimmer included a heating system to keep the bitumen viscous enough for the skimmer to be able to remove it properly (e.g., at a temperature of about 100° F. to about 150° F.). The removed bitumen contained less than 2% by weight of solids (i.e., clay and sand).

The removed bitumen was mixed with additional separating composition at a ratio of 2:3. The mixture was pumped through a separate double stacked attritor disperser with 4 blades. The mixture was kept at about 140° F. by use of a steam heat exchanger. The attritor disperser discharged into another vessel, the Second Separation Vessel. This vessel was a rectangular shaped 200 gallon tank. The mixture was then allowed to separate.

The mixture separated into three separate layers comprising a bitumen layer, a separating composition layer, and a solids layer. The solids layer flocculated to the bottom of the tank. Essentially immediately upon entering the tank, the bitumen layer began to float to the top. The bitumen layer was removed using a skimmer. The removed bitumen contained more than 99% by weight of the bitumen present in the oil sands. The removed bitumen was more than 99% free of clay and sand, using a standard bitumen, solids and water field test method.

The separating composition from the Second Separation Vessel was allowed to overflow into the Primary Separation Vessel to allow for recycling of the separating composition.

Example 7

Separation of Bitumen from Athabasca Oil Sands (Sulfuric Acid Formulation)

A beaker containing separating composition (Composition 7, below) was charged with 300 g of Athabasca oil sands. The resultant slurry was heated to between 54° C. and 60° C. A high shear lab mixer was lowered into the beaker and the slurry was stirred at 3500 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

Composition 7

TABLE 7

| Amount (grams) | Ingredient |
|---|---|
| 183 | Water |
| 8.2 | Sulfuric Acid 98% |
| 1.05 | Sodium acid pyrophosphate |
| 13.0 | Caustic soda (50%) |
| 2.73 | Tetrapotassium pyrophosphate (60%) |
| 0.52 | MAPHOS ® 66 H ESTER |

The beaker contents were allowed to cool, at which time the bitumen was removed from the beaker. The bitumen was determined to be greater than 99% free of contaminants, including sand and clay. Approximately 45 g of bitumen was recovered, representing greater than 99% of all of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 100.00 g of the dried sand was placed in a beaker. 100 g of toluene was added to the sand. The resultant slurry was agitated, then allowed to settle. The toluene was decanted from the sand. The decanted toluene was visually inspected and found to be clear. The sand was dried again at 72° C. for 8 hours to evaporate any remaining toluene. Thereafter, the sand was weighed and approximately 99.8 g of sand remains.

Unless specifically stated to the contrary, the numerical parameters set forth in the specification, including the attached claims, are approximations that may vary depending on the desired properties sought to be obtained according to the exemplary embodiments. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Furthermore, while the systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A bitumen-recovery process for use with a bitumen-containing composition and a separating composition, comprising the steps of:

a. mixing the bitumen-containing composition with a first separating composition to produce a slurry;

b. subjecting the slurry to high speed, high shear mixing to produce a mixed slurry;

c. allowing the mixed slurry to separate into at least 3 layers comprising a first bitumen layer, a first separating composition layer, and a first solids layer;

d. removing the first bitumen layer;

e. mixing the first removed bitumen layer with additional a second separating composition to produce a mixed bitumen layer;

f. allowing the mixed bitumen layer to separate into at least 3 layers comprising a second bitumen layer, a second separating composition layer and a second solids layer;

g. removing the second bitumen layer;

h. wherein the first bitumen layer contains 2% by weight or less of clay and sand, wherein the second bitumen layer contains at least 99% by weight of the bitumen present in the bitumen-containing composition and is at least 99% free of clay and sand.

2. A process as claimed in claim 1 wherein the first separating composition and the second separating composition haves a pH of 7 to 8.5 and comprises a hydrotropic agent, a dispersant having flocculating characteristics and optionally a wetting agent.

3. A process as claimed in claim 1 wherein the bitumen-containing composition comprises oil sands, tailings, process water, sludge, or a combination thereof.

4. A process as claimed in claim 1 wherein the bitumen-containing composition is oil sands.

5. A process as claimed in claim 1 further comprising the step of grinding the bitumen-containing composition before mixing with the first separating composition.

6. A process as claimed in claim 1 wherein a conveying apparatus is utilized to move the bitumen-containing composition to a separate container where it is mixed with the first separating composition.

7. A process as claimed in claim 1 wherein the first separating composition and the bitumen-containing composition are mixed in a ratio of about 3:1 to about 1:1.

8. A process as claimed in claim 1 wherein the high speed mixing utilizes a mixer with blades that operate at a tip speed of at least 27 meters per second.

9. A process as claimed in claim 8 wherein the mixer blades are coated with a coating selected from the group consisting of tungsten carbide, ceramics, and combinations thereof.

10. A process as claimed in claim 1 wherein the mixed slurry is subjected to aeration.

11. A process as claimed in claim 1 wherein a conveying apparatus is used to remove the first solids layer.

12. A process as claimed in claim 1 wherein the first and second solids layers consist essentially of sand and clay.

13. A process as claimed in claim 1 wherein the solids flocculate out of the mixed slurry as said slurry is allowed to separate into layers.

14. A process as claimed in claim 1 wherein the first bitumen layer contains 2% or less clay and has a thickness of about 4000 to 6000 cps at 140 F.

15. A process as claimed in claim 1 wherein a skimmer is utilized to remove the first bitumen layer.

16. A process as claimed in claim 15 wherein the skimmer is heated.

17. A process as claimed in claim 1 wherein the removed first bitumen layer is placed in a separate container and heated to at least about 140 F.

18. A process as claimed in claim 1 wherein the removed first bitumen layer and the additional second separating composition are mixed in a ratio of about 3:1 to about 1:1.

19. A process as claimed in claim 1 wherein a skimmer is utilized to remove the second bitumen layer.

20. A process as claimed in claim 19 wherein the skimmer is heated.

21. A process as claimed in claim 1 wherein the second separating composition layer is recycled and utilized with an additional quantity of a bitumen-containing composition.

22. A process as claimed in claim 1 wherein the first separating composition and the second separating composition are is heated to a temperature of about 100 to about 150 F before mixing with the ground composition.

23. A process as claimed in claim 1 wherein the process is a continuous process.

24. A process as claimed in claim 1 wherein the process is a batch process.

25. A process as claimed in claim 1 wherein at least 75% of the sand is allowed to settle out of the slurry before it is subjected to high speed mixing.

26. A bitumen-recovery process for use with a bitumen-containing composition and a separating composition comprising the steps of:

a. mixing the bitumen-containing composition with a first separating composition to produce a slurry;
b. allowing the slurry to settle such that at least 75% of the sand within the slurry settles out of the slurry before it is subjected to high speed mixing;
c. subjecting the slurry to high speed, high shear mixing to produce a mixed slurry;
d. allowing the mixed slurry to separate into at least 3 layers comprising a first bitumen layer, a first separating composition layer, and a first solids layer;
e. removing the first bitumen layer;
f. mixing the removed first bitumen layer with additional a second separating composition to produce a mixed bitumen layer;
g. allowing the mixed bitumen layer to separate into at least 3 layers comprising a second bitumen layer, a second separating composition layer and a second solids layer;
h. removing the second bitumen layer;
wherein the first bitumen layer contains 2% by weight or less of clay and sand,
wherein the second bitumen layer contains at least 99% by weight of the bitumen present in the bitumen-containing composition and is at least 99% free of clay and sand, and
wherein the first separating composition and the second separating composition haves a pH of 7 to 8.5 and each comprises about 0.1 to about 4.0% by weight of hydrotropic agent, about 0.25% to about 4.5% by weight of dispersant having flocculating characteristics, about 1.7% to about 8.6% by weight of a heavy acid, about 2% to about 9.5% by weight of base, and optionally a wetting agent.

27. A process as claimed in claim 26 wherein the bitumen-containing composition comprises oil sands, tailings, process water, sludge, or a combination thereof.

28. A process as claimed in claim 26 wherein the bitumen-containing composition is oil sands.

29. A process as claimed in claim 26 further comprising the step of grinding the bitumen-containing composition before mixing with the first separating composition.

30. A process as claimed in claim 26 wherein a conveying apparatus is utilized to move the bitumen-containing composition to a separate container where it is mixed with the first separating composition.

31. A process as claimed in claim 26 wherein the first separating composition and the bitumen-containing composition are mixed in a ratio of about 3:1 to about 1:1.

32. A process as claimed in claim 26 wherein the high speed mixing utilizes a mixer with blades that operate at a tip speed of at least 27 meters per second.

33. A process as claimed in claim 32 wherein the mixer blades are coated with a coating selected from the group consisting of tungsten carbide, ceramics, and combinations thereof.

34. A process as claimed in claim 26 wherein the mixed slurry is subjected to aeration.

35. A process as claimed in claim 26 wherein a conveying apparatus is used to remove the first solids layer.

36. A process as claimed in claim 26 wherein the solids layer consists essentially of sand and clay.

37. A process as claimed in claim 26 wherein the solids flocculate out of the mixed slurry as said slurry is allowed to separate into layers.

38. A process as claimed in claim 26 wherein the first bitumen layer contains 2% or less clay and has a thickness of about 4000 to 6000 cps at 140 F.

39. A process as claimed in claim 26 wherein a belt skimmer is utilized to remove the first bitumen layer.

40. A process as claimed in claim 39 wherein the belt skimmer is heated.

41. A process as claimed in claim 26 wherein the removed first bitumen layer is placed in a separate container and heated to at least about 140 F.

42. A process as claimed in claim 26 wherein the removed first bitumen layer and the additional second separating composition are mixed in a ratio of about 3:1 to about 1:1.

43. A process as claimed in claim 26 wherein a skimmer is utilized to remove the second bitumen layer.

44. A process as claimed in claim 43 wherein the skimmer is heated.

45. A process as claimed in claim 26 wherein the second separating composition layer is recycled and utilized with an additional quantity of a bitumen-containing composition.

46. A process as claimed in claim 26 wherein the first separating composition and the second separating composition are is heated to a temperature of about 100 to about 150 F before mixing with the ground composition.

47. A process as claimed in claim 26 wherein the process is a continuous process.

48. A process as claimed in claim 26 wherein the process is a batch process.

49. A process as claimed in claim 26 wherein at least 75% of the sand is allowed to settle out of the slurry before it is subjected to high speed mixing.

* * * * *